United States Patent [19]

Meier et al.

[11] 4,079,869

[45] Mar. 21, 1978

[54] DEVICE FOR REPLACING POURING PIPES ATTACHED TO METALLURGICAL VESSEL SPOUTS

[75] Inventors: Ernst Meier, Kilchberg; Hans Müller, Cham, both of Switzerland

[73] Assignee: Stopinc Aktiengesellschaft, Zug, Switzerland

[21] Appl. No.: 750,413

[22] Filed: Dec. 14, 1976

[30] Foreign Application Priority Data

Dec. 20, 1975 Germany ..... 2557726

[51] Int. Cl.[2] ..... B22D 41/08

[52] U.S. Cl. ..... 222/600; 164/337; 222/607

[58] Field of Search ..... 164/281, 337; 222/591, 222/600, 607, 598, 601, 606, 602

[56] References Cited

U.S. PATENT DOCUMENTS

| | | | |
|---|---|---|---|
| 2,753,606 | 7/1956 | Fogt | 222/602 |
| 2,957,936 | 10/1960 | Bugge | 222/601 X |
| 3,435,882 | 4/1969 | Falk | 164/337 X |
| 3,743,007 | 7/1973 | Simons et al. | 222/600 X |
| 3,884,400 | 5/1975 | Tuschak et al. | 222/607 |

FOREIGN PATENT DOCUMENTS

| | | | |
|---|---|---|---|
| 1,083,262 | 9/1967 | United Kingdom | 222/591 |

*Primary Examiner*—Robert B. Reeves
*Assistant Examiner*—David A. Scherbel
*Attorney, Agent, or Firm*—Wenderoth, Lind & Ponack

[57] ABSTRACT

A pivot is mounted to extend parallel to a spout axis. A pair of arms are mounted at first ends thereof to swivel about the pivot and carry at second ends thereof holders which support pouring pipes. Each arm can be swiveled to a position beneath the spout and precisely centered with the spout by abutment devices. The holder and pouring pipe are then raised until the pouring pipe engages the spout.

18 Claims, 8 Drawing Figures

DEVICE FOR REPLACING POURING PIPES ATTACHED TO METALLURGICAL VESSEL SPOUTS

BACKGROUND OF THE INVENTION

The present invention relates to a device for replacing trumpet assemblies or pouring pipes employed on the spouts of metallurgical vessels, in particular on a spout arranged on an intermediate container of a continuous casting installation and of the type which is closable by means of a slide closure. More particularly, the present invention relates to such a device including at least two holders that can each receive a pouring pipe to be alternately moved into a position beneath the spout, coupled to the spout, and then removed therefrom.

It is well known that pouring pipes are employed on the spouts of intermediate containers to protect the melt discharged therefrom against oxidation on the way to the ingot mold and to obtain a stable melt inflow of uniform distribution through the cross-section of the ingot mold. Pouring pipes made of a refractory material are thus exposed to enormous thermal and chemical erosive attack. Such pouring pipes are generally replaced as often as possible during the casting sequence and normally before other parts which are subjected to wear during a continuous casting operation. A pouring pipe that becomes useless through corrosion or wear must be replaced rapidly and reliably, so that the formation of an ingot in the ingot mold is not interrupted.

Swiss Pat. No. 500,033 discloses a device for pouring, with replaceable pouring pipes, in continuous casting installations, wherein the pouring pipes can be transported to and away from a position beneath the bottom spout of the intermediate container and thereat can be lifted and lowered, such transport being effected on a track provided on either side of the spout. The track, which consists of guide rails, extends between the ingot mold and the spout of the intermediate container and guides two carriages, each having a holder for a pouring pipe. One carriage holds a pouring pipe in an operational position, while the other carriage is positioned at an end of the track whereat the worn pouring pipe is replaced. The pouring pipe at the operational position is pressed against the spout, either by a spring which acts on the pouring pipe holder in a direction toward the spout when the carriage moves into position, or by lifting the entire guide track by means of pressure cylinder units.

However, this known device is relatively expensive and, due to the arrangement of the main parts thereof between the intermediate container and the ingot mold, is quite bulky and complex. Further, the guide track becomes relatively hot, which is detrimental for the device and which thus may cause defects during the operation of the device.

SUMMARY OF THE INVENTION

Accordingly, the object of the present invention is to provide a structurally simplified pouring pipe replacement device which is operationally reliable and the handling of which is improved.

This object is achieved according to the invention in that the pouring pipe holders are provided at the ends of swivel arms which are pivotally mounted about a pivot which is parallel to the longitudinal axis of the spout axis. The arms alternately may be swiveled about the pivot to align and center the pipe beneath the spout.

The pouring pipe holders and/or the swivel arms are provided with devices to vertically displace the pouring pipe into coupling engagement with the spout. In this arrangement, the end of the swivel arm which is in the operational position is positioned in the critical area between the intermediate container and the ingot mold. However, every other structural element of the device is arranged outside the area directly effected by the casting heat, so that the device can be reliably and satisfactorily operated. Moreover, the pouring area remains substantially free of bulky structural parts and is thus clear for inspection. Furthermore, the starting position of the pouring pipe to be moved into coupling engagement with the spout is automatically and accurately achieved by stop or abutment devices. Therefore, the coupling movement can be promptly effected through the operation of the displacement device.

The swivel arms are preferably arranged one above the other on a common pivot, and each arm has a supporting ring at a first end thereof. The rings are situated at the same level by providing that one of the swivel arms is bent downwardly by a greater amount than the other swivel arm. Both swivel arms have an axially vertically displaceable holder which supports a pouring pipe therein secured against rotation. This arrangement is simple with regard to construction and guarantees the proper positioning of the pouring pipe in relation to the ingot mold.

The present invention further provides that the stop device be provided on the pouring pipe holder, on the one hand, and on stationary metal parts of the spout area, on the other hand, and be formed as base for the displacement device. Specifically, the arrangement can be such that projections extend outwardly of the pouring pipe holder and have vertical abutment surfaces. The projections engage catch hooks that project downwardly from the spout on diametrally opposite sides thereof. Wedge-shaped or eccentric-shaped displacement elements act between the catch hooks and projections to raise the holder and pouring pipe. Such an arrangement can be readily operated and substantially meets the requirements of a rough casting operation.

In an alternative embodiment, the displacement device includes a vertically displaceable swivel arm pivot which can be raised or lowered, and thereby raise the arms, by means of a self-locking the manually operable drive. The alignment and centering of the pouring pipe in position beneath the spout can be fixed by abutments or stops attached to the swivel arms and an abutment pin arranged on the spout closure. Thus, centering and alignment can be effected by operation from a position spaced from the spout area.

In both embodiments it may be advantageous to mount the pouring pipe holders in the supporting rings attached to the swivel arms by means of compression springs. This makes it possible to provide a sensitive contact pressure of the pouring pipe against the spout, particularly when the displacement device includes manually operated eccentrics or gear-type displacement drives.

For many applications of the device of the invention it is of advantage to cool the spout and/or pouring pipe area with air or to supply a scavenging gas, e.g. argon, to such areas. The conduits required for this purpose are preferably provided in the swivel arms. The swivel arm pivot may have a bore therethrough connected to a gas connection and communicating through radial bores with bores through the swivel arms. The swivel arms may be joined through ducts in the supporting rings to the pouring pipe areas, and also through further ducts provided, e.g. in the holders, to the spout areas.

In accordance with a further feature of the present invention, the swivel arm pivot may be fixedly mounted with respect to the intermediate container, e.g. by means of a bracket attached to the slide housing, preferably on the longitudinal side of the spout closure housing that is situated on the side of the intermediate container which is free of overflow grooves.

BRIEF DESCRIPTION OF THE DRAWINGS

Other objects, features and advantages of the present invention will be apparent from the following detailed description of exemplary embodiments thereof, taken with the accompanying drawings, wherein.

DETAILED DESCRIPTION OF THE INVENTION

Figure 1:
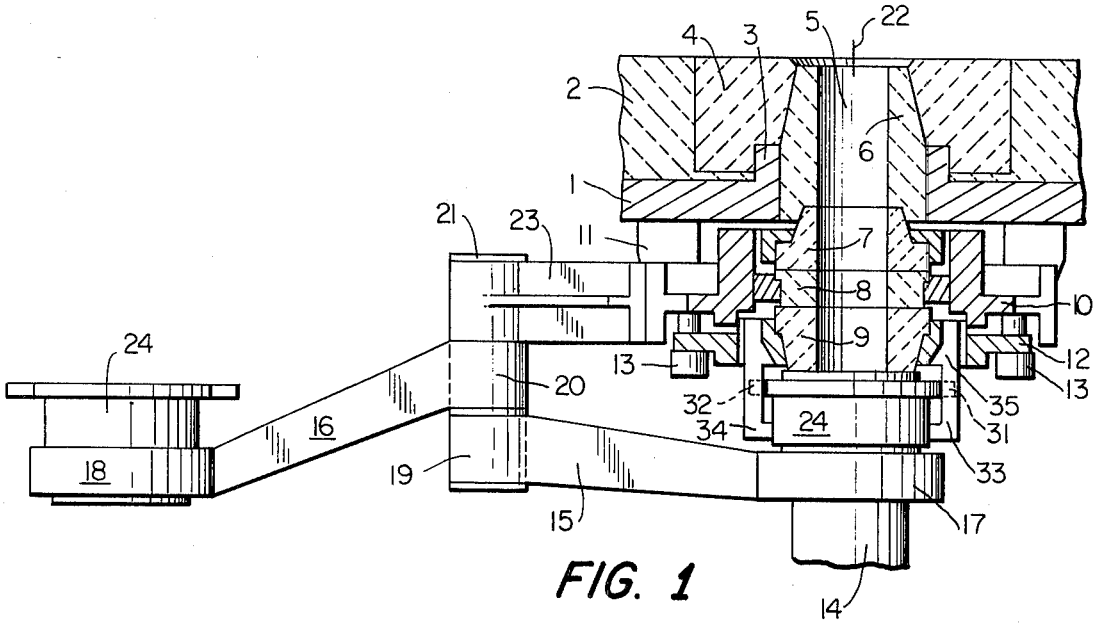
FIG. 1 is an elevation view of a first embodiment of the pouring pipe replacement device of the invention, shown in operative position with a spout of a slide closure which is shown in section.

As shown in FIG. 1, an intermediate container of a continuous casting installation includes a metal bottom 1 and a refractory lining 2 having a pouring spout therethrough. Bottom 1 is perforated in the area of the spout and has a collar 3 projecting toward the interior of the container. A spout or nozzle brick 4 and an outlet sleeve 6 having a spout passage 5 therethrough are positioned on the collar. Sleeve 6 has positioned therebelow a stationary refractory bottom plate 7, a displaceable refractory slide plate 8 and a further stationary refractory outlet plate 9 of a slide closure. Plates 7, 8 and 9, through which spout passage 5 is continued, are mounted in a slide housing 10 that is detachably mounted on a frame 11 which is attached to metal bottom 1. Housing 10 is closed by a housing cover 12. Sealing contact pressure between plates 7, 8 and 9 is provided by cover bolts 13. However, such a pressure allows slide plate 8 to be displaced in a direction perpendicular to the plane of FIG. 1 by means of a displacement device, which is conventional and which is thus not shown, for opening or closing slide closure 7–13.

A trumpet assembly or pouring pipe 14 can be engaged with and coupled to the lower plane surface of stationary outlet plate 9 of the slide closure by means of the pouring pipe replacement device of the invention. Such device includes at least two swivel or pivot arms 15 and 16 which are provided at first ends thereof with supporting rings 17 and 18, respectively, and at second ends thereof with bearings 19 and 20, respectively. The arms 15 and 16 are supported by means of respective bearings 19 and 20, one above the other, on a common pivot 21. Arm 16 is mounted above arm 15 and is bent downwardly so that the supporting rings 17 and 18 are positioned at the same level. Pivot 21 is supported by a bracket 23 to extend axially parallel with longitudinal axis 22 of the spout. Bracket 23 is rigidly attached in any suitable manner to the container, or preferably to the slide closure. The specific structure of this attachment is not particularly important, as long as the bracket is stably supported, but as shown in FIG. 1 bracket 23 has a flange which is fixedly connected to slide housing 10.

Figure 4:
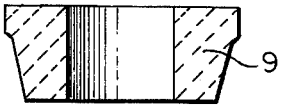
FIG. 4 is a section through the bottom outlet plate of the slide closure shown in FIG. 1, but removed from its holder.
Figure 3:
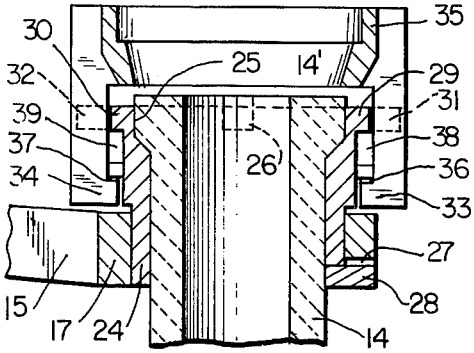
FIG. 3 is a section on an enlarged scale through a pouring pipe positioned in a portion of the replacement device of FIG. 1.
Figure 5:
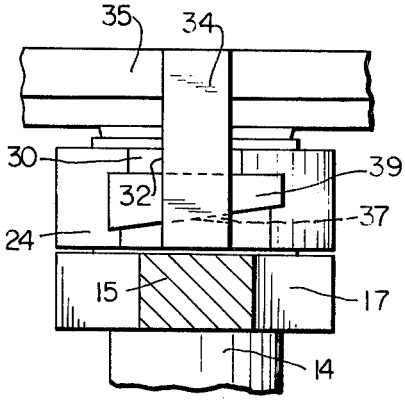
FIG. 5 is an elevation of the structure of FIG. 3, as viewed from the left side in FIG. 3.

A sleeve shaped pouring pipe holder 24 is arranged in each supporting ring 17 and 18. The holder 24 of ring 17 is shown in detail in FIGS. 3 and 4. A pouring pipe 14 fits within holder 24 and has a thickened inlet or upper portion 14' which is positioned within a milled recess 25 of holder 24, so that the upper surface of pipe 14 extends somewhat above the upper surface of holder 24. Pipe 14 is secured against rotation within holder 24 by means such as tongue and groove coupling 26. Coupling 26 may consist of a groove in one of pipe 14 or holder 24 and a tongue or rib in the other of holder 24 or pipe 14. Other conventional rotation preventing devices could be used. Also, holder 24 has a lower flange or abutment resting on respective supporting ring 17 or 18, and is prevented from rotation with respect thereto. This may be achieved by suitable means such as a latch 28 attached to holder 24 and engaging in a recess 27 in ring 17. This engagement structure also operates to limit the upward stroke of holder 24 and pipe 14 with respect to ring 17.

Figure 2:
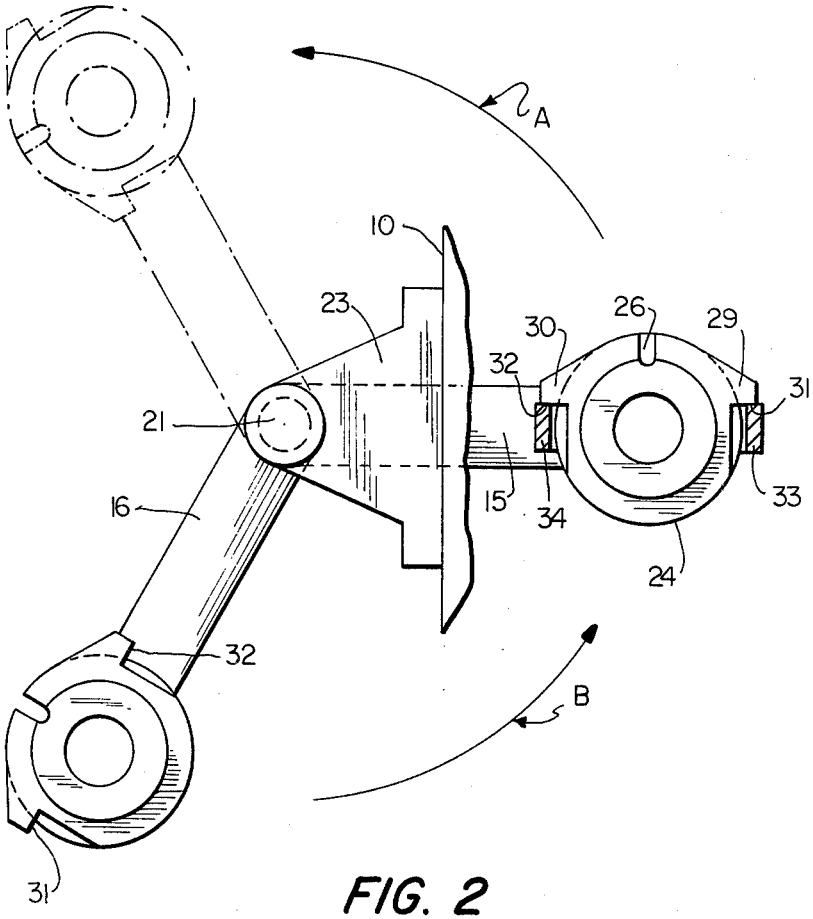
FIG. 2 is a plan view of the replacement device of FIG. 1.

The upper end of holder 24 has a flange with two outwardly extending projections 29 and 30 which face each other and which have thereon stop or abutment surfaces 31 and 32 defined by a chord extending across the circular configuration of holder 24. Surfaces 31 and 32 are vertical and respectively abut against catch hooks 33 and 34 when pouring pipe 14 is swung to a position beneath the spout. Catch hooks 33 and 34 project downwardly from the slide closure and are attached to opposite sides of a metal holder 35 that carries stationary outlet plate 9. The catch hooks face each other diametrally of the spout, so that pouring pipe holder 24 can be swung into a position such that the stop surfaces 31 and 32 respectively contact vertical sides of hooks 33 and 34. For example, and as shown in FIG. 2, when arm 15 is positioned below the spout stop surfaces 31 and 32 of the holder 24 thereof respectively abut first surfaces of hooks 33 and 34, i.e. the upper surfaces thereof as shown in FIG. 2. This abutment precisely centers and aligns the pouring pipe beneath the plate 9. When the pipe supported by arm 15 is to be replaced, and after the pipe is uncoupled from plate 9, in a manner to be discussed below, arm 15 is swung around pivot 21 in the direction of arrow A. Arm 16 is then swung in the direction of arrow B to a position such that stop surfaces 31 and 32 of the holder 24 thereof respectively abut second surfaces, i.e. the lower surfaces as shown in FIG. 2, of hooks 33 and 34. This abutment precisely centers and aligns the pouring pipe supported by arm 16 beneath the plate 9.

The hook-shaped ends of catch hooks 33 and 34 are dimensioned to extend below the respective projections 29 and 30 by a sufficient distance to produce slots 36 and 37 therebetween. Wedges 38 and 39 are respectively inserted into slots 36 and 37. The insertion of wedges 38 and 39 causes the upper wedge surfaces to push upwardly against respective bottom surfaces of projections 29 and 30. This causes holder 24, and thus pipe 14, to be moved upwardly until the upper surface of pipe 14 firmly engages the lower surface of plate 9.

The above described apparatus operates as follows.

A worn pouring pipe 14 is replaced when the slide closure is closed and the intermediate container is lifted. Pouring pipe holder 24 and pipe 14 are first lowered by withdrawing wedges 38 and 39, such that pouring pipe 14 is no longer coupled to plate 9 of the slide closure. Then swivel arm 15 is pivoted out from beneath the spout in the direction of arrow A. At the same time, the other swivel arm 16, loaded with a new pipe 14, is pivoted from the opposite side in the direction of arrow B to a position beneath the spout. The new pouring pipe 14 is then coupled to plate 9 by again introducing wedges 38 and 39 and lifting holder 24 and pipe 14. The contact pressure between pouring pipe 14 and outlet pipe 9 of the slide closure may be improved by providing therebetween a refractory packing of fibrous material, which is conventional and thus not illustrated.

Figure 6:
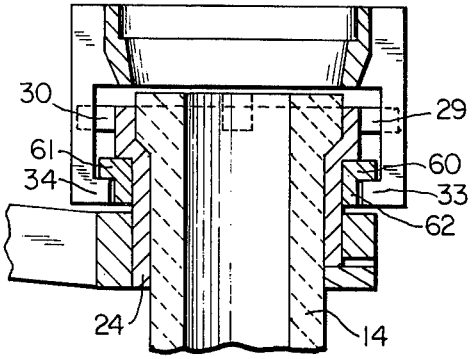
FIGS. 6 and 7 are views similar to FIGS. 3 and 5, respectively, but showing a slight modification of the structure for raising and lowering the pouring pipe.
Figure 7:
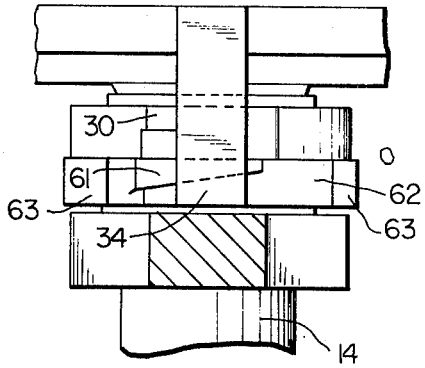

In place of wedges 38 and 39, as shown in FIGS. 6 and 7, a wedge ring 62 having thereon wedges 60 and 61 is positioned between an upper flange of pouring pipe holder 24 and catch hooks 33 and 34. By rotating wedge ring 62, e.g. by applying force to projections 63 provided on the periphery of ring 62, the holder 24 and pipe 14 can be raised or lowered with respect to plate 9.

Figure 8:
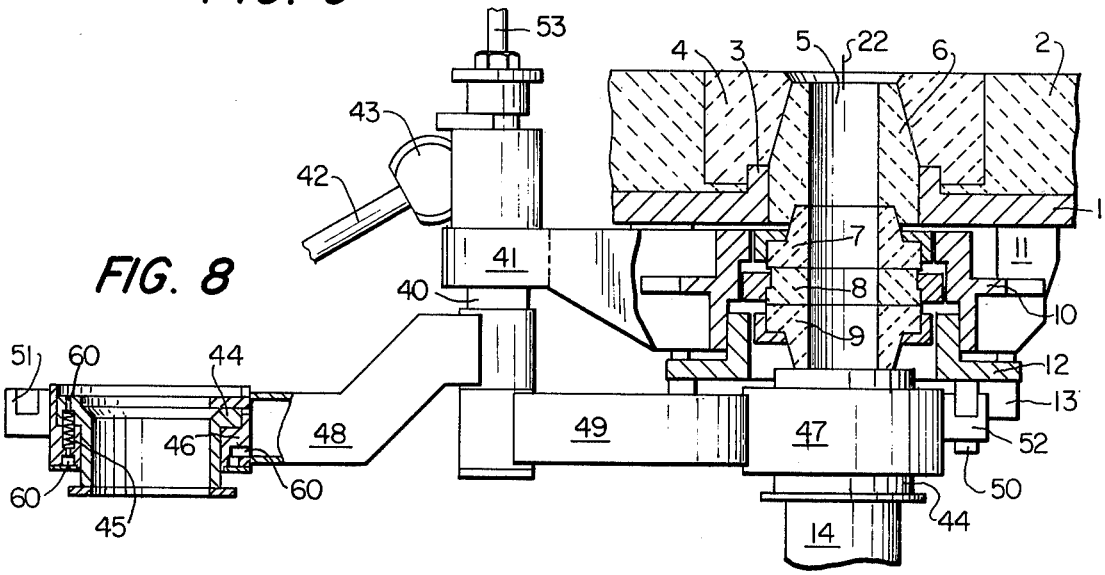
FIG. 8 is a view similar to FIG. 1, but illustrating a second embodiment of the replacement device of the invention.

In a second embodiment of the invention as illustrated in FIG. 8, the vertical displacement of pouring pipe 14 is provided by a swivel arm pivot 40, which is vertically displaceably mounted in a bracket or guide 41. Pivot 40 may be vertically displaced by suitable means, such as a self-locking gear drive 43, operable by means such as a hand lever 42. Thus, vertical displacement of pivot 40 causes vertical displacement of arms 48 and 49, as well as the respective holders 44 and pipes 14.

Pouring pipe holders 44 are vertically displaceably mounted in supporting rings 46 and 47 of swivel or pivot arms 48 and 49, respectively, and are urged upwardly by compression springs 45. Therefore, when hand lever 42 is operated to move the arm 48 or 49 and the respective holder 44 and pouring pipe 14 upwardly toward outlet plate 9, springs 45 cause resilient contact pressure between pipe 14 and plate 9. Precise centering and alignment of pipe 14 beneath plate 9 is achieved by abutment between an abutment 50 on the slide closure and a lug or eyelet 51 or 52 attached to respective supporting rings 46 or 47.

As shown in FIG. 8, cooling air or scavenging gas may be supplied to the spout and pouring pipes through a gas connection 53, into a central bore in pivot 40, through hollow swivel arms 48 and 49, and through appropriate orifices and channels 60 in supporting rings 46 and 47 and holders 44. Furthermore, although not shown in the drawings for the sake of simplicity and clarity of illustration, cooling air and/or scavenging gas may be supplied to the spout and pouring pipes of the embodiment of FIGS. 1–7, by structure similar to that shown in FIG. 8.

Other modifications may be made to the above described specific structural arrangements without departing from the scope of the invention. For instance, the replacement device may include more than two pivot or swivel arms. Further, compression springs such as 45 may be employed in the embodiment of FIGS. 1–7. Additionally, lifting devices other than wedges 38 and 39 or wedge ring 62 may be employed. Even other structural modifications, still within the scope of the invention, will be apparent to those skilled in the art.

What is claimed is:

1. A device for replacing pouring pipes on the spout of a metallurgical vessel, particularly a spout in an intermediate container of a continuous casting installation and closable by a slide closure, the pouring pipe being coupled in an operative position to the bottom of the spout, said device comprising:

a pivot adapted to be mounted parallel to the longitudinal axis of a spout;

at least two swivel arms pivotally mounted at first ends thereof one above the other about said pivot;

each said arm having at a second end thereof a pouring pipe holder adapted to receive therein a pouring pipe;

said arms being alternately pivotable about said pivot to an operative position such that the respective pouring pipe is centered and aligned beneath the spout;

abutment means associated with each said arm for limiting the amount of pivoting motion thereof to the said respective operative position thereof; and means, operatively associated with said arms, for displacing the respective said holder and pouring pipe held thereby in a direction coaxial with said spout axis to selectively engage the said pouring pipe against said spout and to release such engagement.

2. A device as claimed in claim 1, wherein each of said arms has at said second end thereof a supporting ring, the respective said holder being positioned in said ring.

3. A device as claimed in claim 2, wherein all of said rings are positioned at the same level measured axially of said pivot.

4. A device as claimed in claim 2, further comprising means for preventing rotation of each said holder relative to the respective said ring.

5. A device as claimed in claim 2, further comprising compression spring means positioned between each said ring and the respective said holder.

6. A device as claimed in claim 2, wherein said abutment means comprises an abutment pin on the slide closure, and an abutment lug attached to each said ring.

7. A device as claimed in claim 2, further comprising means for supplying cooling air or scavenging gas through said arms to the area of the pouring pipe and spout.

8. A device as claimed in claim 7, wherein said supplying means comprises a bore through said pivot connected to bores through said arms, and orifices connected to said bores in said arms and extending through said rings and said holders.

9. A device as claimed in claim 1, further comprising means for preventing rotation of each said pouring pipe relative to the respective said holder.

10. A device as claimed in claim 1, wherein said abutment means comprises a first stationary member connected to the slide closure, and second members, one each connected to a respective one of said holders.

11. A device as claimed in claim 10, wherein said displacing means is movably positioned between said first and second members.

12. A device as claimed in claim 10, wherein said first member comprises catch hooks extending downwardly from the spout on diametrally opposite sides thereof, and said second members comprise pairs of projections on each said holder, said projections having vertical surfaces which abut said catch hooks when the respective said arm is in said operative position thereof.

13. A device as claimed in claim 12, wherein said catch hooks extend downwardly past said projections to provide a slot between each projection and respective catch hook.

14. A device as claimed in claim 13, wherein said displacing means comprise a pair of wedges, one each insertable in a respective said slot between one said projection and the respective said catch hook.

15. A device as claimed in claim 13, wherein said displacing means comprises a wedge ring mounted about each said holder, said wedge ring having thereon a pair of wedges, one each insertable in a respective said slot between one said projection and the respective said catch hook.

16. A device as claimed in claim 1, wherein said pivot is displaceably mounted in a direction parallel to said spout axis, and said displacing means comprises a device for displacing said pivot and thus said arms in said direction.

17. A device as claimed in claim 16, wherein said displacing device comprises a manually operable self-locking gear drive.

18. A device as claimed in claim 1, further comprising bracket means for rigidly mounting said pivot to a housing of the slide closure in a position with said pivot extending parallel to said spout axis.

* * * * *